US005864120A

United States Patent [19]

Vroom et al.

[11] Patent Number: 5,864,120

[45] Date of Patent: Jan. 26, 1999

[54] CONVECTION OVEN WITH MODULAR CONTROL PANEL

[75] Inventors: Robert Vroom; Thomas C. Hotard, both of Fuquay-Varina, N.C.

[73] Assignee: Middleby-Marshall, Inc., Elgin, Ill.

[21] Appl. No.: 808,423

[22] Filed: Feb. 28, 1997

[51] Int. Cl.[6] ..... A21B 1/26; F27D 19/00; F24C 15/00

[52] U.S. Cl. ..... 219/400; 219/414; 219/507; 219/720

[58] Field of Search ..... 219/412–414, 219/507, 702, 715, 720, 400; 126/21 A

[56] References Cited

U.S. PATENT DOCUMENTS

| | | | |
|---|---|---|---|
| 5,676,044 | 10/1997 | Lara | 219/400 |
| 5,726,424 | 3/1998 | Koether | 219/414 |
| 5,956,531 | 9/1990 | Braunisch et al. | 126/21 A |

FOREIGN PATENT DOCUMENTS

| | | |
|---|---|---|
| 3234042 | 3/1984 | Germany . |
| 55-000855 | 1/1980 | Japan . |

*Primary Examiner*—Teresa J. Walberg
*Assistant Examiner*—J. Pelham
*Attorney, Agent, or Firm*—Rhodes, Coats & Bennett, L.L.P.

[57] ABSTRACT

A convection oven includes a plurality of modular control panels which can be interchanged with one another to change the functional capability of the oven. The base unit contains the basic structural and mechanical components of the convection oven including a heating element and blower. Each of the individual control panels can control the operation of the heating element and blower in the base unit. Each control panel will include a different group of controls. All of the available control panels plug into a standard interface on the base unit. Therefore, the functional capabilities of the oven can be changed by removing the existing control panel on the base unit and reinstalling a different control panel.

18 Claims, 8 Drawing Sheets

CONVECTION OVEN WITH MODULAR CONTROL PANEL

FIELD OF THE INVENTION

The present invention relates generally to a convection oven, and more particularly, to a system of modular control panels for a convection oven which can be interchanged to change the functional capability of the oven.

BACKGROUND OF THE INVENTION

Most manufacturers of convection ovens offer a variety of models based on a single basic design. Usually, the manufacturer's line will include a base model having only a narrow range of functions, a deluxe model having a broad range of functions, and several intermediate models having varying ranges of function in between the base model and the deluxe model. Having several models to select from is deemed necessary from a marketing perspective since customer needs vary. However, the multiplication of the number of designs creates problems from a manufacturing and servicing perspective.

In order to make delivery of goods in a relatively short period of time, most manufacturers will maintain an inventory of each individual model which is offered for sale. The greater the number of individual models offered for sale, the greater will be the inventory requirements. Maintaining a large inventory of goods ties up capital that might be allocated for other purposes and increases the space requirements for the manufacturing operation.

Having a large number of different models also increases the cost of servicing the units sold. First, having a large number of different models increases the number of replacement parts that may be needed. Since service personnel seldom carry a complete inventory of all replacement parts that may be needed, the service personnel may not always have the needed parts when a service call is made. Consequently, the service personnel will have to place orders for the needed parts and make additional service calls after the parts are received. The necessity for additional service calls not only increases the cost of service, but inconveniences the manufacturer's customer. Having a large number of different models also increases training costs of service personnel who must learn how to repair and maintain each of the different models offered by the manufacturer.

Another problem with preexisting designs is that there is seldom a way to upgrade a less expensive model to have the features of a more expensive model after the initial purchase. Thus, if the customer decides after a year of use that he would like certain features in a more expensive model, then the customer would have to purchase an entirely new oven from the manufacturer. The customer may insist that the manufacturer allow a trade-in which costs the manufacturer additional money.

Accordingly, there is a need for a convection oven having modular components which can be used on a variety of different models so as to reduce inventory requirements, promote ease of service, and provide an upgrade path for customers of the manufacturer of the invention.

SUMMARY OF THE INVENTION

The present invention solves the problem of the prior art by providing a system of modular control panels for a convection oven which can be interchanged with one another to change the functional capabilities of the oven. The convection oven of the present invention comprises a base unit containing the basic structural and mechanical components of a convection oven, and one of a select group of interchangeable control panels.

The base unit of the oven includes a cabinet having an insulated oven chamber in which the food items are placed, a heating cavity for heating air used to cook the food, and a blower for drawing the heated air from the heating chamber into the oven cavity, circulating the air within the oven cavity, and expelling air through an exhaust passageway. The control panel includes all of the controls for the convection oven such as the power switch, timer, thermostat, and fans speed control. Additional controls, such as additional timers and thermostats and mode control switches may also be included on the control panel depending upon the model. All of the available control panels from the select group plug into a standard interface on the base unit. Therefore, the functional capabilities of the oven can be changed by removing the existing control panel on the convection oven and reinstalling a different control panel having the same standard interface.

The present invention solves many of the problems associated with prior art designs. First, the present invention reduces inventory requirements substantially since the manufacturer need only stock the base unit and each of the individual control panels. The control panels can then be installed on the base unit at the time orders are shipped depending on which model oven was ordered by the customer. The present invention also improves the ease of servicing the units. The service personnel can carry one or more of the different control panels as well as the usual assortment of replacement parts. If the service personnel does not have the appropriate parts to repair an oven when making a service call, then one of the control panels can be installed even if it does not correspond to the model purchased by the customer. The defective control panel can then be taken back to a repair shop where it can be repaired and tested in the shop. Finally, the present invention allows a customer who purchases a less expensive model to upgrade his oven to a more expensive model simply by swapping control panels

DETAILED DESCRIPTION OF THE DRAWINGS

Figure 1:
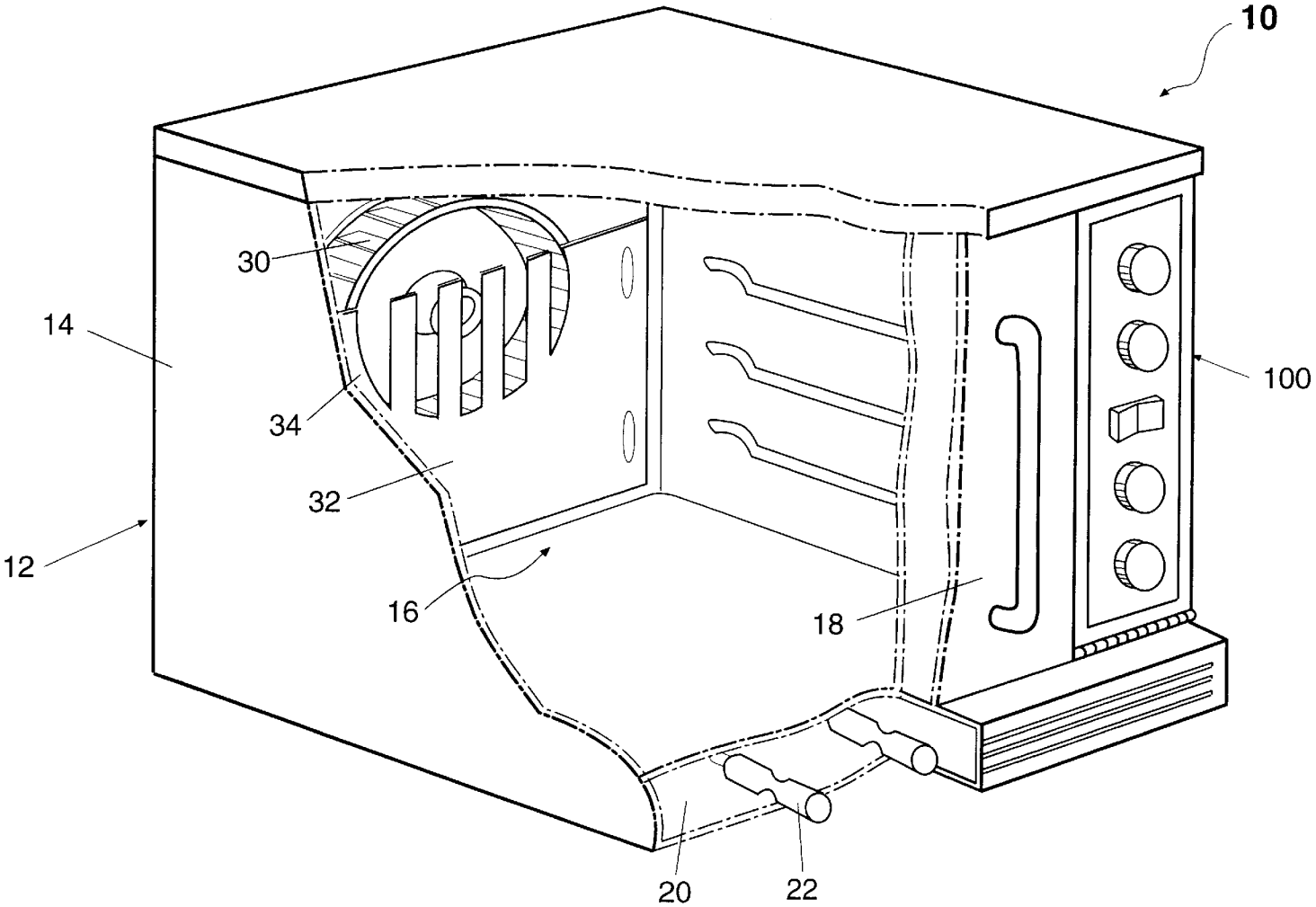
FIG. 1 is a perspective view of the convection oven of the present invention with a portion cut away to show the interior thereof.

Referring now to the drawings, and particularly to FIG. 1, there is shown a convection oven constructed in accordance with the present invention which is indicated generally by the numeral 10. The convection oven 10 includes a base unit 12 and a plurality of modular control panels 100 which can be interchanged with one another to change the functional capabilities of the oven. Each individual control panel 100 plugs into a standard interface on the base unit 12 so that there is no need to make any changes to the base unit 12.

The base unit 12 comprises a cabinet 14 having a cooking cavity 16 defined therein. An access door 18 is mounted to the front of the cabinet 14 to provide access to the cooking cavity 16. A heating chamber 20 is disposed below the floor of the cooking cavity 16. The heating chamber 20 is open at the front end and communicates with a vertical flue chamber (not shown) in the back of the oven cabinet 14. One or more heating elements are disposed within the heating chamber 20 to heat air. It will be appreciated by those skilled in the art that the heating elements could also be located in the cooking cavity. The disclosed embodiment uses a plurality of gas burners 22 which are located adjacent the open front end of the heating chamber 20. Those skilled in the art will recognize, however, that electrical heating elements could be used.

A blower 30 is located in the back of the cooking cavity 14. A baffle 32 with a central opening 34 is disposed in front of the blower to define a separate compartment for the blower 30 in the rear of the cooking cavity 14. The blower 30 draws heated air from the heating chamber 20 into the cooking cavity 16 and circulates the heating air within the cooking cavity 16. As air is drawn into the cooking cavity 14 by the blower 30, an equal amount of air is exhausted through an exhaust passageway (not shown).

Figure 2:
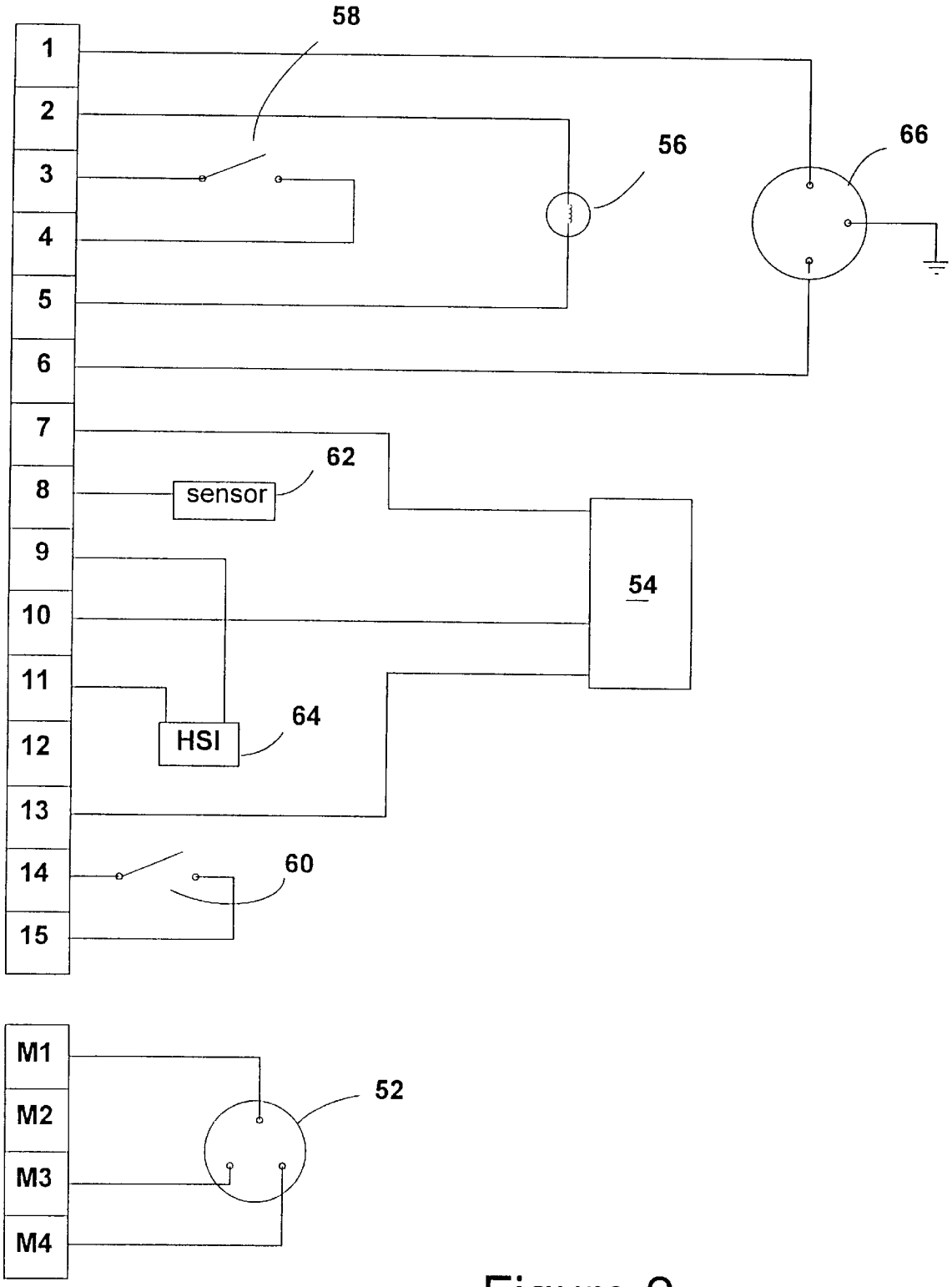
FIG. 2 is a wiring diagram for the base unit of the convection oven.

FIG. 2 is a wiring diagram showing the base unit electrical system which is indicated generally by the numeral 50. The base unit electrical system includes a fan motor 52, a gas valve 54, an interior light 56, a door switch 58, a centrifugal switch 60, a temperature sensor 62, and an igniter 64. Power is supplied by a standard 115 volt A/C power cord 66.

The fan motor 52 drives the blower 30. The gas valve 54 controls the gas supply to the burners 22. The igniter 64 is used to ignite the burners 22. The interior light 56 is used to light the interior of the cooking cavity 14. The fan motor 52, gas valve 54, light 56, and igniter 64 constitutes the controlled elements of the base unit 12. The operation of the controlled elements of the base unit 12 is controlled by the control panel 100 as will be hereinafter described.

In addition to the controlled elements, the base unit electrical system 50 includes a number of sensing devices which provide information to the control panel 100 which is used to control the operation of the controlled elements. The sensing elements in the base unit 12 include the door switch 58, the centrifugal switch 60 and the sensor 62. Although located in the base unit 12, these elements can be thought of as extensions of the control circuit on the control panel 50.

The door switch 58 controls the operation of the fan motor 52 in certain modes of operation as will be later described. The centrifugal switch 60 is used to shut-off the gas valve 54 when the fan motor 52 is not operating. Flame sensor 62 is used to detect the presence of a flame emitting from the burner 22 and to shut-off the gas valve 54 when no flame is present.

The base unit electrical system 50 includes a standard interface to connect the base unit electrical system 50 with each of the control panels 100. That is, each control panel 100, though different from the other control panels, plugs into the same standard interface on the base unit 12. The interface includes a main plug 70 and an auxiliary plug 72 as shown in FIG. 2. The main plug 70 is a 15-pin, plug-type connector. The auxiliary plug 72 is a four-pin, plug-type connector.

Figure 3:
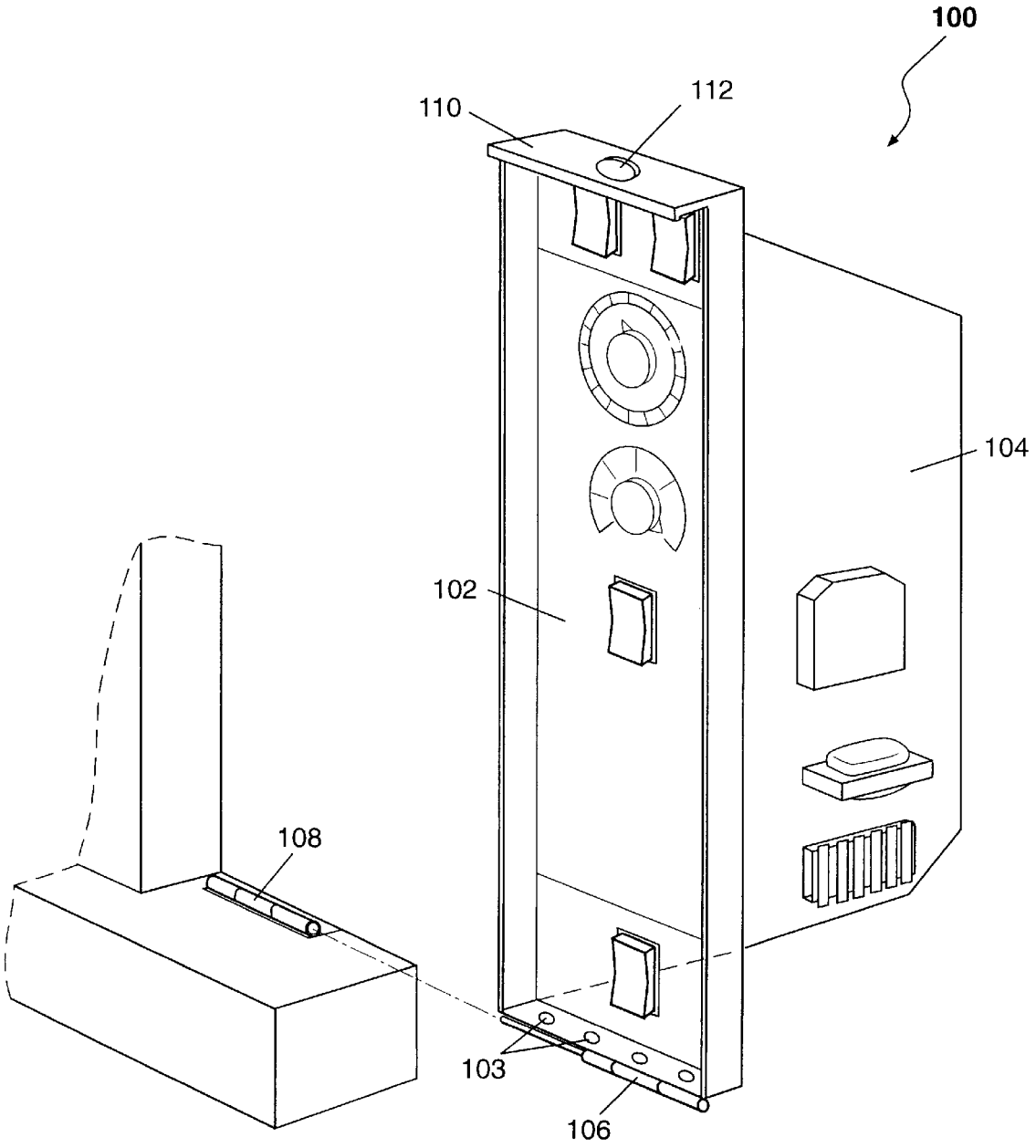
FIG. 3 is a partial perspective view showing how the control panel of the convection oven mounts to the base unit.
Figure 4:
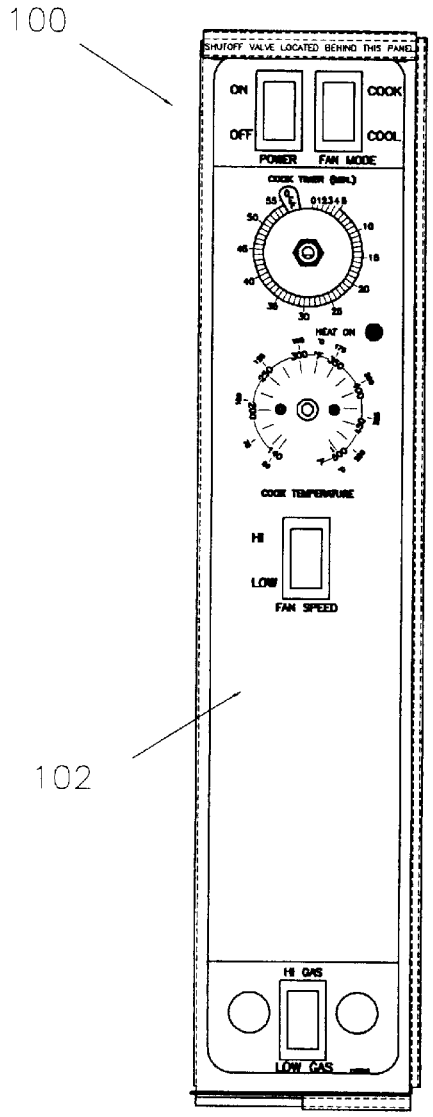
FIG. 4 is a front elevation of one control panel.
Figure 5:
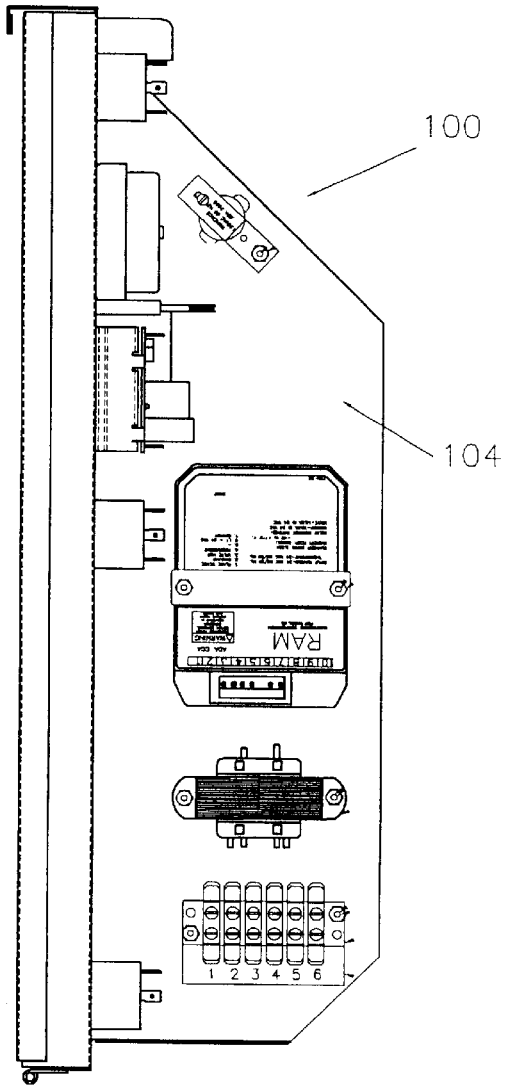
FIG. 5 is a right side elevation of the control panel shown in FIG. 4.

The control panel 100, shown in FIGS. 3–5, is detachably mounted to the base unit 12. The control panel 100 includes all of the controls for the convection oven such as the power switch, timer, thermostat, and fan speed control. Additional controls, such as mode control switches, may also be included on the control panel. The controls mounted to the control panel control the operation of the heating element 22, blower 30 or other controlled elements in the base unit 12. A wiring harness connects each of the controls on the control panel 100 to the base unit electrical system 50.

The present invention includes a plurality of individual control panels 100, each having a slightly different group of controls. Certain basic controls are common to each control panel 100. However, each individual control panel 100 will have a combination of controls that is unique to that particular panel. All of the control panels 100 include a wiring harness which connects it to the standard interface on the base unit 12. Consequently, one control panel 100 can be replaced by a different control panel 100 simply by unplugging and removing the old panel and then installing and "plugging in" the new panel.

Each control panel 100 includes a face panel 102 and a support panel 104. The face panel 102 is the panel that is visible to the user from the front of the oven. The support panel 104 projects inwardly from the inside surface of the face panel 102. The support panel 104 is not visible to the user unless the control panel 100 is removed from the base unit 12.

To mount the control panel 100 to the base unit 12, one-half of a hinge connector 106 is secured to the bottom edge of the face panel 102 by screws 103. The other half of the hinge connector 58 is mounted to the base unit 12. As shown in FIG. 3, the hinge 106 on the control panel 100 slides into the main hinge connector 108 on the base unit 12. The hinge allows the control panel 100 to pivot outwardly to provide access to the controls for servicing and repair. A bracket 110 is secured to the top of the face panel 102. The bracket 110 includes an opening 112 which aligns with a threaded hole (not shown) in the top of the oven cabinet 14. A bolt (not shown) passes through the hole 112 in bracket 110 and screws into the threaded hole in the oven cabinet 14 to secure the control panel 100. To remove the control panel 100 from the base unit 12, the screw securing the control panel 100 is removed to allow the control panel 100 to slide off the hinge connector 108 on the base unit 12. The side panel of the oven cabinet 14 prevents the control panel 100 from being removed unless the side panel is also removed. Alternatively, the hinge 106 may be removed in order to remove the control panel from the front without the need of removing the side panel.

Figure 7:
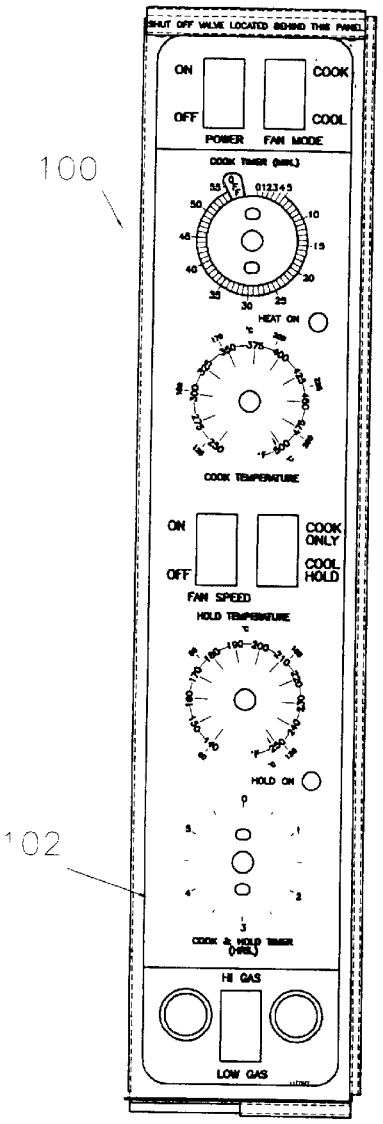
FIGS. 6 and 7 are front elevations of a second and third control panel, respectively, that can be interchanged with the first control panel.
Figure 6:
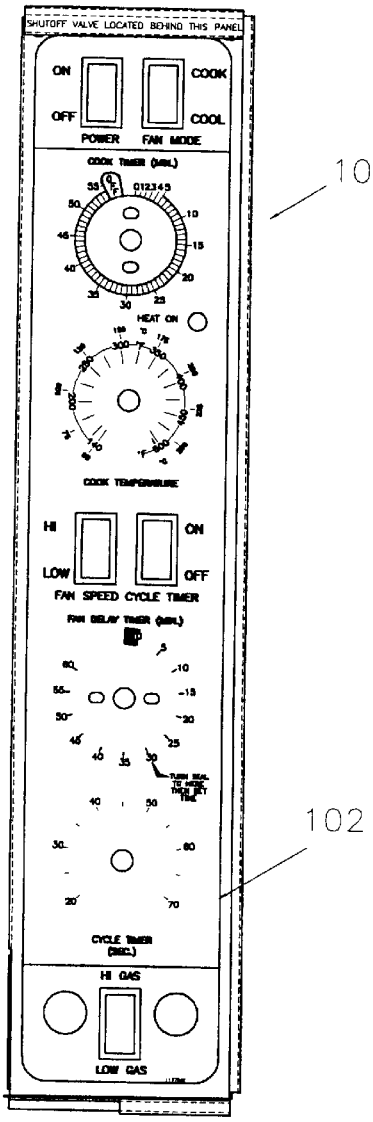

FIGS. 6 and 7 show front elevations of two additional control panels which are interchangeable with the panel 100 shown in FIGS. 3–5. These panels are constructed in the same manner as the panel shown in FIGS. 3–5. It should be understood, therefore, that numbers in FIGS. 6 and 7 that have like numbers in FIGS. 3–5 indicate like parts.

Figure 8:
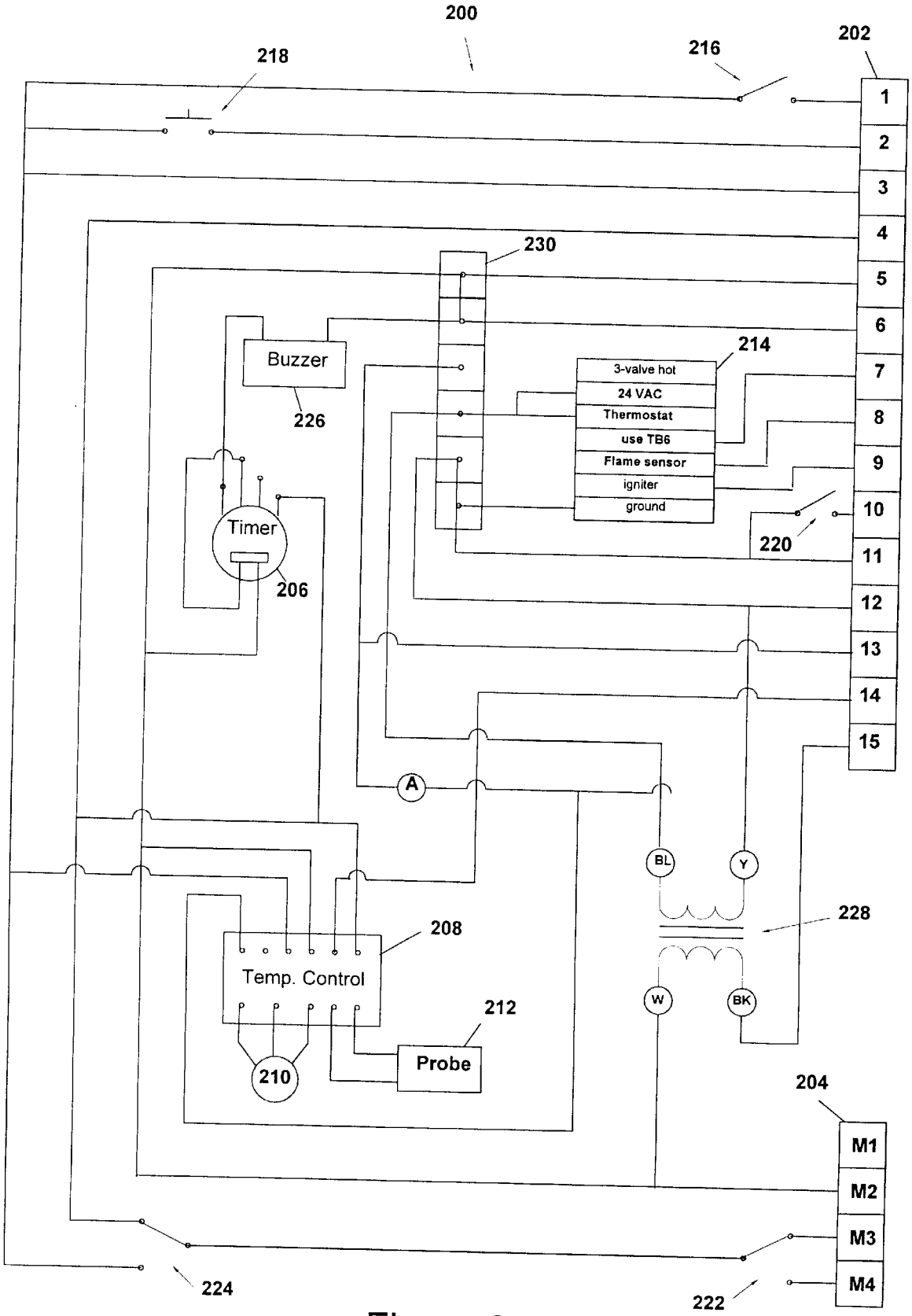
FIG. 8 is a wiring diagram showing the oven with the first control panel.

Referring now to FIG. 8, there is shown an electrical schematic diagram showing the control circuit 200 for a base model of the convection oven, which corresponds to the control panel in FIGS. 3–5. The control circuit 200 is mounted to the control panel 100. The control circuit 200 includes a main plug 202 and an auxiliary plug 204 which mate with corresponding plugs 70 and 72 on the base unit 12. The controls include a timer 206, temperature control board 208, potentiometer 210, probe 212, ignition module 214, power switch 216, light switch 218, gas hi/lo switch 220, fan speed switch 222, and fan switch 224. The circuit 200 also includes a buzzer 226 to provide an audible warning in the case of an alarm condition. Transformer 228 provides a 12-volt alternating current for the circuit. A terminal block 230, which is mounted to the control panel 100, is used for making the necessary connections.

The temperature control board 208 controls the cooking temperature of the convection oven 10. The cooking temperature is set by the potentiometer 210. Probe 212 is used to measure the temperature within the cooking cavity 16.

The ignition module 214 controls the gas valve 54 in the base unit 12 and the igniter. The ignition module 214 opens the gas valve 54 in response to a demand for additional heat from the temperature control board 208. The ignition module 214 also shuts off the gas valve 54 when the desired temperature is reached or when the flame to one of the burners is extinguished. The gas flow rate is controlled by the high/low switch 220.

The power switch 216 controls the power to the oven 10. The light switch 218 controls the interior light 56 in the cooking cavity 16 of the base unit 12. The gas high/low switch 220, as already mentioned, controls the supply of gas to the burners 22. The fan speed switch 222 controls the speed of the blower 30 when the blower 30 is turned on. The fan switch 224 controls the fan operation relative to the door position. In the cook position, the blower 30 and heat source are on when the doors are closed. Opening the door shuts off the blower 30 and heat source. In the cool position, the fan is on regardless of whether doors are open or closed. Opening doors in the cool mode, however, causes the heat source to shut off. Thus, the fan will always be on when the power to the unit is on unless the fan switch 224 is in the cook position and the doors are open. The fan 224 does not cycle with the heat source.

Figure 9:
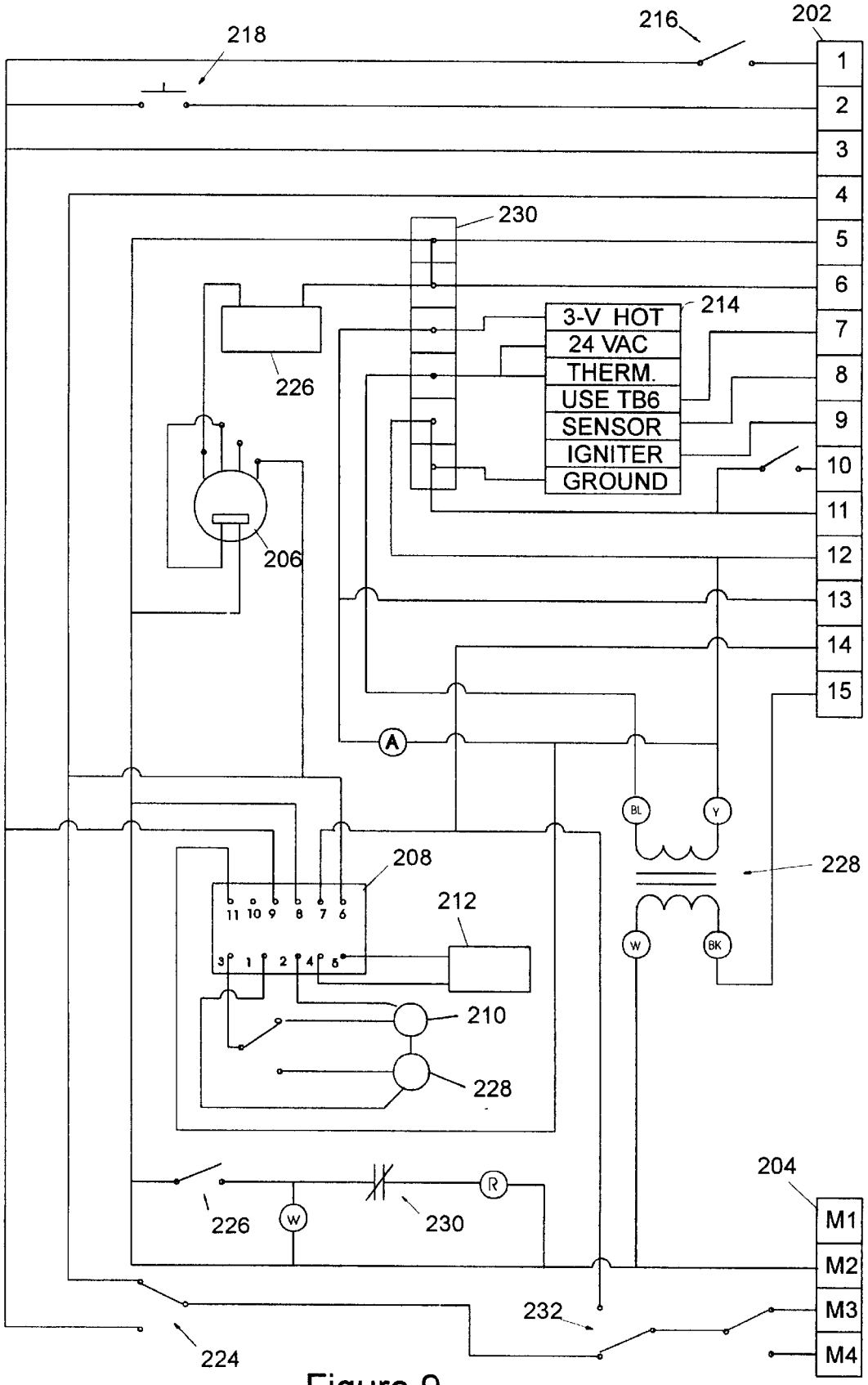
FIG. 9 is a wiring diagram showing the oven with the second control panel.

Referring now to FIG. 9, a second control circuit is shown. The circuit shown in FIG. 5 is similar to the circuit shown in FIG. 8. Like numbers in FIGS. 8 and 9 indicate like parts. The control circuit 200 includes a main plug 202 and an auxiliary plug 204 which mate with corresponding plugs 70 and 72 on the base unit 12. The controls include, in addition to those previously described, a mode switch 226, hold temperature control 228, hold timer 230, and relays 232 and 234. When the mode switch 226 is in the cook position, the control circuit 200 operates in the same manner as the control circuit 200 shown in FIG. 8. When the mode switch 226 is in the "cook and hold" position, the hold temperature control 228 and hold timer 230 are activated. These controls are used to keep the oven heated for a predetermined period of time after the cooking cycle is completed. The hold timer 230 is used to set the length of the holding period once the cooking cycle is completed. The hold temperature control is used to set the holding temperature which is usually lower than the cooking temperature.

Referring now to FIG. 6, a control circuit for the third control panel is shown. The circuit shown in FIG. 6 is substantially similar to the circuit shown in FIG. 8 except that the circuit shown in FIG. 6 has a few additional controls. The additional controls include a fan delay timer 240, cycle timer switch 242, and cycle relay 244. The cycle timer switch 240 is used to select the mode of operation. Two modes are allowed, cook mode and cycle mode. In cook mode, the circuit shown in FIG. 10 operates in the same manner as the circuit shown in FIG. 8. When the switch 340 is closed, cycle mode is selected. In cycle mode, the fan delay timer causes the blower 30 to operate intermittently for a predetermined period of time at the beginning of the cook cycle. The fan delay timer sets the time period for such intermittent operation. The cycle relay controls the length of the on and off periods during intermittent operation. Once the fan delay timer 242 is expired, normal operation is resumed and the blower 30 operates continuously.

Figure 10:
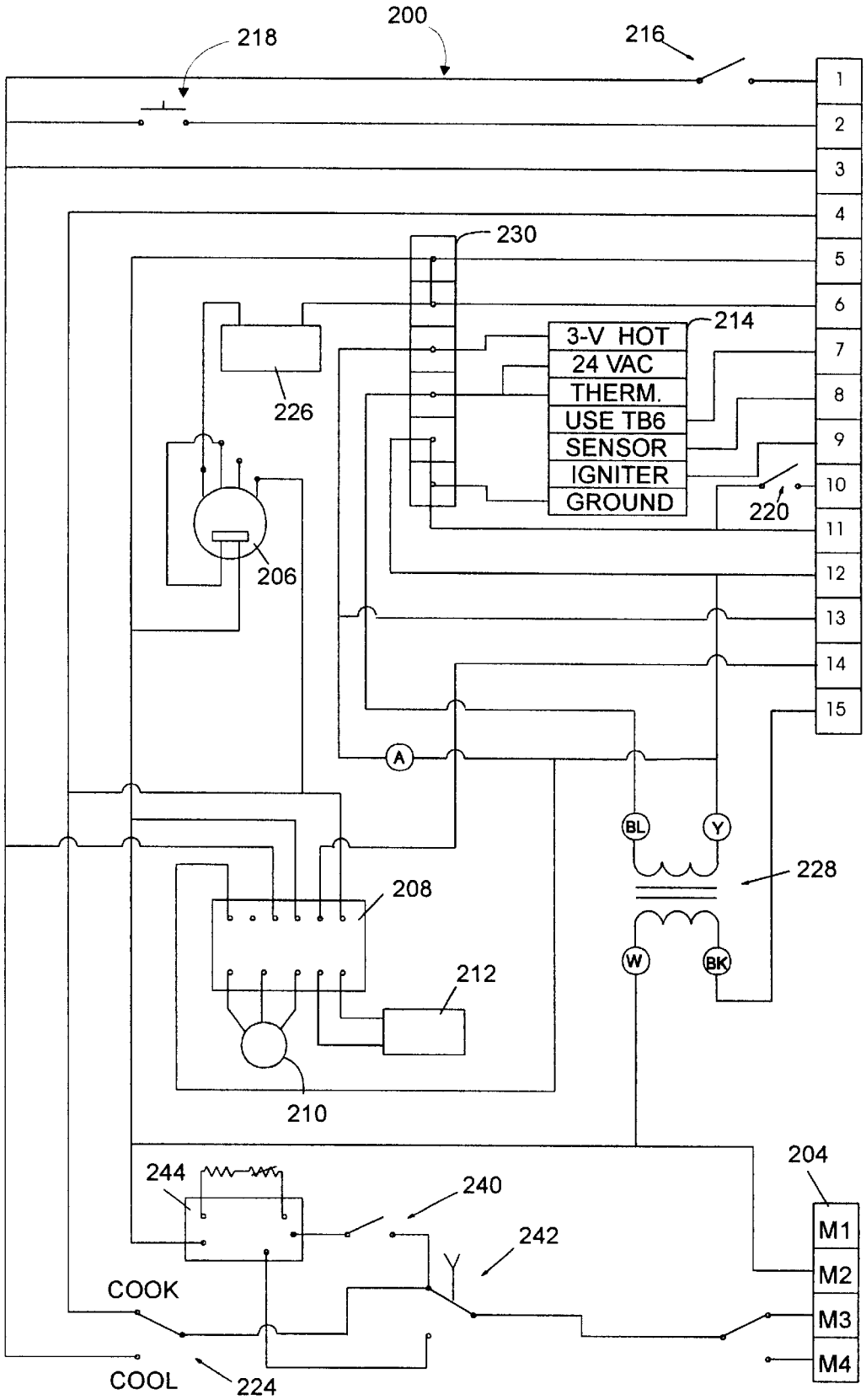
FIG. 10 is a wiring diagram showing the oven with the third control panel.

The control circuits shown in FIGS. 8, 9 and 10 are contained on separate control panels 100. It should be noted that each of the circuits described bear the same standard interface. Accordingly, a control panel 100 with either one of these three circuits can plug into the standard interface on the base unit 12.

By sharing a common interface among a plurality of different control panels, a number of problems with prior art designs are solved. First, since the same base unit 12 can be used with a plurality of different control panels, inventory requirements are reduced. The base unit 12 and each of the individual control panels 100 can be stored in inventory until orders are received. At the time the orders are shipped, the control panels 100 corresponding to the model ordered can be installed on the base unit 12 and shipped. Second, the present invention should substantially reduce servicing costs. The service personnel can carry each of the individual control panels in addition to the usual assortment of replacement parts. If a replacement part is not available when a service call is made, the entire control panel can be removed and replaced by a new control panel. The control panel can be replaced. Replacement of the control panel can be made even if the service panel does not have an identical control panel since all of the control panels interface in the same way with the base unit 12.

Finally, the present invention allows purchasers of the convection ovens to upgrade their ovens subsequent to their initial purchase. For example, if the customer purchases a base model and later decides that he or she wants a more expensive model, an upgrade can be accomplished by simply changing the control panel on the oven.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A convection oven comprising:

a) a base unit including:

i) a cooking cavity to receive food items to be cooked;

ii) a plurality of controlled elements including a heating element for heating air and a blower for circulating said heated air in said cooking chamber;

b) a plurality of separate, modular control panels which can be inserted into said base unit, each of said modular control panels including:

i) a plurality of controls for controlling the operation of said controlled elements;

ii) a support panel to which said controls are mounted; and c) connecting means for connecting said control panel to said controlled elements on said base unit;

d) wherein each control panel includes a set of controls that differ from the controls on the other modular control panels so that the functional capability of said oven can be varied by interchanging said control panels in said base unit.

2. The convection oven of claim 1 wherein said controlled elements includes an interior light within said cooking cavity in said base unit.

3. The convection oven of claim 1 wherein said heating element is a gas burner and said controlled elements includes a gas valve in said base unit to control the gas supply to the gas burner.

4. The convection oven of claim 1 wherein said controlled elements includes an electric motor for actuating said blower in said base unit.

5. The convection oven of claim 1 wherein said connecting means is a plug-type connector.

6. The convection oven of claim 1 wherein one of said control panels includes controls to control the temperature of the cooking cavity during a cooking cycle.

7. The convection oven of claim 6 wherein one of said control panels includes controls adapted to maintain the temperature of the cooking cavity at a predetermined hold temperature at the end of a cooking cycle.

8. The convection oven of claim 7 wherein one of said control panels includes controls adapted to cause the intermittent operation of the blower for a predetermined period of time during the cooking cycle.

9. A convection oven comprising:

a) a base unit including:

i) a cooking cavity to receive food items to be cooked;

ii) a plurality of controlled elements including a heating element for heating air and a blower for circulating said heated air in said cooking chamber;

iii) an interface connector on said base unit which is electrically connected to said controlled elements;

b) a plurality of separate, modular control panels which can be inserted into said base unit, each of said modular control panels including:

i) a plurality of controls for controlling the operation of said controlled elements;

ii) a support panel to which said controls are mounted;

iii) an interface connector on said control panel which is electrically connected to said controls and which mates with the interface connector on said base unit;

c) mounting means for removably mounting said control panel to said base unit;

d) wherein each control panel includes a set of controls that differ from the controls on the other modular control panels so that the functional capability of said oven can be varied by interchanging said control panels in said base unit.

10. The convection oven of claim 9 wherein said controlled elements includes an interior light within said cooking cavity in said base unit.

11. The convection oven of claim 9 wherein said heating element is a gas burner and said controlled elements includes a gas valve in said base unit to control the gas supply to the gas burner.

12. The convection oven of claim 9 wherein said controlled elements includes an electric motor for actuating said blower in said base unit.

13. The convection oven of claim 9 wherein said interface connectors are plug-type connectors.

14. The convection oven of claim 9 wherein one of said control panels includes controls to control the temperature of the cooking cavity during a cooking cycle.

15. The convection oven of claim 14 wherein one of said control panels includes controls adapted to maintain the temperature of the cooking cavity at a predetermined hold temperature at the end of a cooking cycle.

16. The convection oven of claim 15 wherein one of said control panels includes controls adapted to cause the intermittent operation of the blower for a predetermined period of time during the cooking cycle.

17. The convection oven of claim 9 wherein said mounting means comprises a hinge.

18. The convection oven of claim 17 wherein said hinge includes a first part mounted to said base unit and a second part mounted to said control panel, wherein one of said first and second parts includes a hinge pin that slides into the other part.

* * * * *